United States Patent [19]

Dieval

[11] Patent Number: 4,960,055

[45] **Date of Patent: * Oct. 2, 1990**

[54] PROJECTILE COMPRISING SUB-PROJECTILES WITH A PRE-DEFINED ZONE OF EFFECTIVENESS

[75] Inventor: Gérard Dieval, Neuilly, France

[73] Assignee: Thomson-Brandt Armements, Boulogne-Billancourt, France

[ * ] Notice: The portion of the term of this patent subsequent to Oct. 18, 2005 has been disclaimed.

[21] Appl. No.: 139,315

[22] Filed: Dec. 29, 1987

[30] Foreign Application Priority Data

Dec. 31, 1986 [FR] France ..... 86 18423

[51] Int. Cl.[5] ..... F42B 13/50

[52] U.S. Cl. ..... 102/489; 102/393; 102/455

[58] Field of Search ..... 102/393, 489, 340, 342, 102/351, 357, 703, 505, 506

[56] References Cited

U.S. PATENT DOCUMENTS

| | | | |
|---|---|---|---|
| 1,340,871 | 5/1920 | Barker et al. | 102/364 |
| 2,809,583 | 10/1957 | Ortynsky | 102/393 |
| 3,088,404 | 5/1963 | Brown | 102/393 |
| 3,093,072 | 6/1963 | Pigman | 102/393 |
| 3,599,568 | 8/1971 | Shellnutt et al. | 102/455 |
| 3,771,455 | 11/1973 | Hass | 102/703 |
| 3,881,416 | 5/1975 | Dilworth, Jr. | 102/703 |
| 3,903,804 | 9/1975 | Luttrell et al. | 102/703 |
| 4,676,167 | 6/1987 | Huber, Jr. et al. | 102/393 |
| 4,777,822 | 10/1988 | Dieval | 102/489 |

FOREIGN PATENT DOCUMENTS

| | | |
|---|---|---|
| 199366 | 6/1908 | Fed. Rep. of Germany . |
| 2934620 | 1/1981 | Fed. Rep. of Germany . |
| 621608 | 5/1927 | France . |

*Primary Examiner*—David H. Brown

*Attorney, Agent, or Firm*—Oblon, Spivak, McClelland, Maier & Neustadt

[57] ABSTRACT

A projectile forms the head of a carrier having a defined ballistic trajectory and comprises sub-munitions that are ejected at a given moment on the trajectory of the projectile and are designed to reach an impact zone with a pre-defined shape. In the main projectile, the sub-munitions are arranged so that:

firstly, they are ejected in a controlled direction, and secondly, at ejection, a cone of dispersion of projectiles with a pre-defined shape is obtained, the said shape being adapted to the shape of the target zone.

3 Claims, 3 Drawing Sheets

PROJECTILE COMPRISING SUB-PROJECTILES WITH A PRE-DEFINED ZONE OF EFFECTIVENESS

BACKGROUND OF THE INVENTION

1. Field of the Invention

The present invention pertains to a projectile forming the head of a carrier, such as a missile, a carrier of this type possibly comprising a propulsion device and being provided with a system of fins or a guidance system so that it has a defined ballistic trajectory.

More precisely, the present invention pertains to a projectile containing sub-munitions which are released at a given moment on the trajectory of the carrier and are designed to reach an impact zone with a pre-defined shape.

2. Description of the Prior Art

Modern weapons systems very often use the concept of the projectile known as the main projectile that carries sub-munitions (or sub-charges) which have to be distributed over large areas or volumes.

In prior art systems, no special precautions are usually taken to arrange the sub-munitions inside the projectile. This results in the random distribution and direction of the sub-munitions when released or, at least, in an appreciable loss of precision in their speed and attitude. As a result only a portion, sometimes a small portion, of the sub-munitions reaches the target zone with accuracy. Furthermore, a target zone with a pre-defined shape has to be swept very widely in order to be effectively covered. This is because of geometrical considerations which shall be described in greater detail further below. Consequently, a major portion of the sub-munitions is lost. This amounts to a loss of weight and place in the main projectile for a given rate of efficiency.

SUMMARY OF THE INVENTION

The aim of the present invention is to optimize the ratio between on-target sub-munitions and lost sub-munitions, it being understood that the term "on-target sub-munitions" applies to sub-munitions that reach a pre-defined target zone in appropriate conditions of speed and attitude.

For this purpose, the sub-munitions are arranged in the main projectile so that, during ejection, a cone of dispersion of sub-munitions is obtained with a pre-defined shape adapted to the shape of the target zone.

BRIEF DESCRIPTION OF THE DRAWINGS

Other objects, specific features and results of the invention, will emerge from the following description which is illustrated by the appended drawings, of which.

In the various figures, the same references refer to the same elements.

DESCRIPTION OF PREFERRED EMBODIMENTS

Figure 1A:
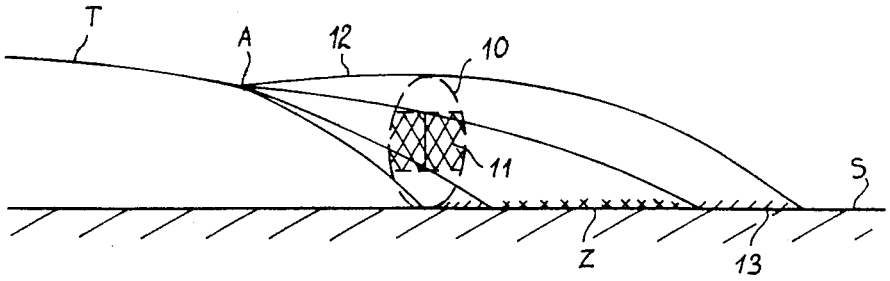
FIGS. 1*a* and 1*b* are explanatory drawings.

FIG. 1*a* is a diagram illustrating the ratio between on-target sub-munitions and lost sub-munitions.

T represents the trajectory of a main projectile in relation to the ground S for example, up to a point A which is the sub-munitions ejection (or release) point. From this point A onwards, the sub-munitions are conventionally ejected in the form of a cone of dispersion 12, the general shape of which recalls that of a cone, modified by the effect of gravity. The intersection of this cone of dispersion 12 with the ground S is a surface 13 called an impact zone. This impact zone is represented, by way of example, in FIG. 1*b* as seen from the top.

Figure 1B:
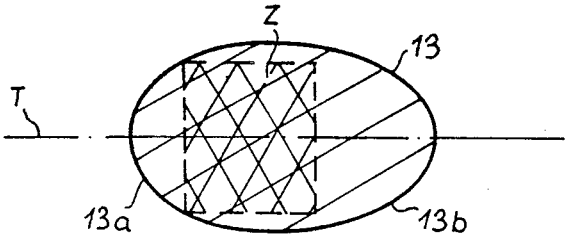

FIG. 1*b* shows, as a reference, the extension of the trajectory T of the main projectile, drawn with dots and dashes.

If the trajectory T were vertical, the impact zone 13 would, of course, be circular. This impact zone changes shape to become a substantially parabolic open curve when the angle of the trajectory T with the ground decreases, namely when the flight path of the main projectile is more horizontal. As is known, modern projectiles tend to fly as close to the ground as possible and, hence, the angle of the cone of dispersion 12 with the ground is generally very small.

FIG. 1*b* shows a gridded zone Z known as the zone of effectiveness which has a predefined shape (for example, a square in this case) and wherein it is desired that the sub-munitions should have maximum efficiency, namely that their speed and attitude should be appropriate to the destruction of a target in this zone. It would appear that if the zone of effectiveness has a shape where the maximum width is of the same magnitude as the maximum length, the impact zone 13 is far greater than the zone Z, especially when the main projectile has a fairly grazing trajectory.

Furthermore, the velocities and densities of the sub-munitions are not homogeneous in the impact zone 13, even when precautions are taken so that, after ejection, the sub-munitions maintain the initial trajectory of the main projectile as well as their attitude on this trajectory. For the impacts are far denser in that part (13*a*) of the zone 13 which is closest to the ejection point (A) than in that part (13*b*) furthest away from it. Furthermore, the velocity of the sub-munitions in the part 13*a* is greater than it would be in the part 13*b*. As a result of this fact, the efficiency of the sub-munitions decreases in proportion to the distance from the ejection point. Hence, the zone of effectiveness Z should not only be entirely covered by the impact zone 13 but should also be preferably located in the part 13*a* of this zone 13.

In FIG. 1*a*, an ellipse 10 drawn with dots and dashes shows a cross-section made in the cone of dispersion 12 before the impact of the said cone of dispersion on the ground and a gridded zone 11 shows that part of the cone of dispersion 12 corresponding to the sub-munitions which will have impact in the zone Z. The sub-munitions contained in the cone of dispersion the zone 11 will not reach the zone of effectiveness Z.

Figure 2:
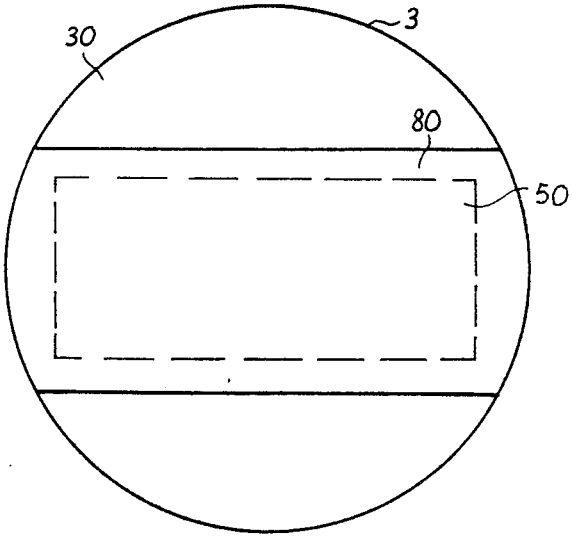
FIG. 2 is a diagram of the arrangement of the sub-munitions according to the invention.

According to the invention, the sub-munitions are arranged in the main projectile in accordance to the shape of the desired zone of effectiveness Z as shown in FIG. 2.

For the calculations and experiments of the Applicant have shown that the cross-section of the cone of dispersion obtained depends on the shape of the loading space cross-section: these two sections are substantially homothetic.

FIG. 2 shows a cross-section view of the casing 3 of the main projectile, and, inside it, by way of example, a rectangle 50 drawn with dots and dashes to represent the sub-munitions loading space in the main projectile.

More precisely, the shape given to the loading space of the sub-munitions depends especially on the shape desired for the zone of effectiveness Z and the angle between the trajectory of the main projectile and the ground. Thus, a rectangular loading space such as 50 in FIG. 2 may correspond to a rectangular or square zone Z depending on the angle of incidence of the trajectory.

The sole condition for the functioning of this device is that the main projectile should have a system that gives it an angular reference, for example, the vertical reference, and a telemetry system such that the ejection point (A) is located at a known distance from the zone of impact.

FIG. 2 further shows means 80 that secure the assembly 50 in the casing 3. It is thus seen that the main projectile will carry only those sub-munitions which effectively have an impact in the pre-defined zone of effectiveness Z thus providing extra space in the main projectile and reduced weight and, by the same token, making it possible to aim a single main projectile at larger zones Z. The spaces (marked 30) left unoccuppied in the casing 3 made be used, for example, to fit in electronic equipment needed for the main projectile.

Figure 3A:
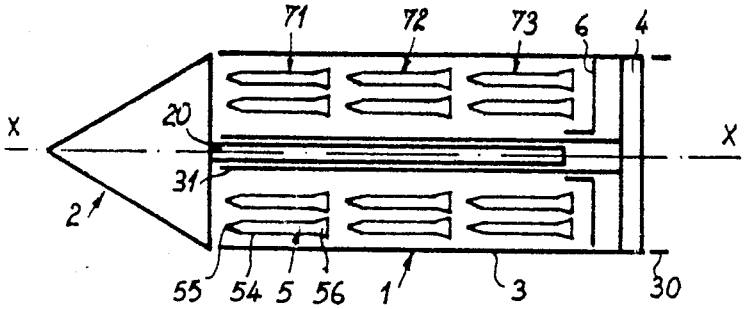
FIGS. 3*a* to 3*c* show an embodiment of the projectile according to the invention and its operation.

FIG. 3*a* represents an embodiment of the projectile according to the invention seen schematically in a longitudinal cross-section.

This projectile, with a longitudinal axis XX, bears the general reference 1 and has a cylindrical casing 3 which ends, on one side, in the nose 2 which has an aerodynamic (for example, substantially conical) shape. At the other end, the projectile is fixed to the rest of the carrier, represented by dashes 30.

Sub-munitions 5 are arranged longitudinally inside the casing 3. Each of them has a cylindrical shell 54 which ends in front in an aerodynamic (for example, substantially conical) head 55 and, on the other side, in a fin system 56 so that it can preserve a given attitude on a given trajectory. The sub-munitions 5 are arranged in the projectile in the transversal arrangement shown in FIG. 2 and longitudinally in one or (as in the example of FIG. 3*a*) several rows marked 71, 72 and 73. They are arranged here so as to be pointed in a single direction, i.e. their head 55 is pointed towards the front of the projectile.

The sub-munitions may be explosive ammunition, counter-measures (infrared or illumination) ammunition, decoy or kinetic energy ammunition.

Figure 4:
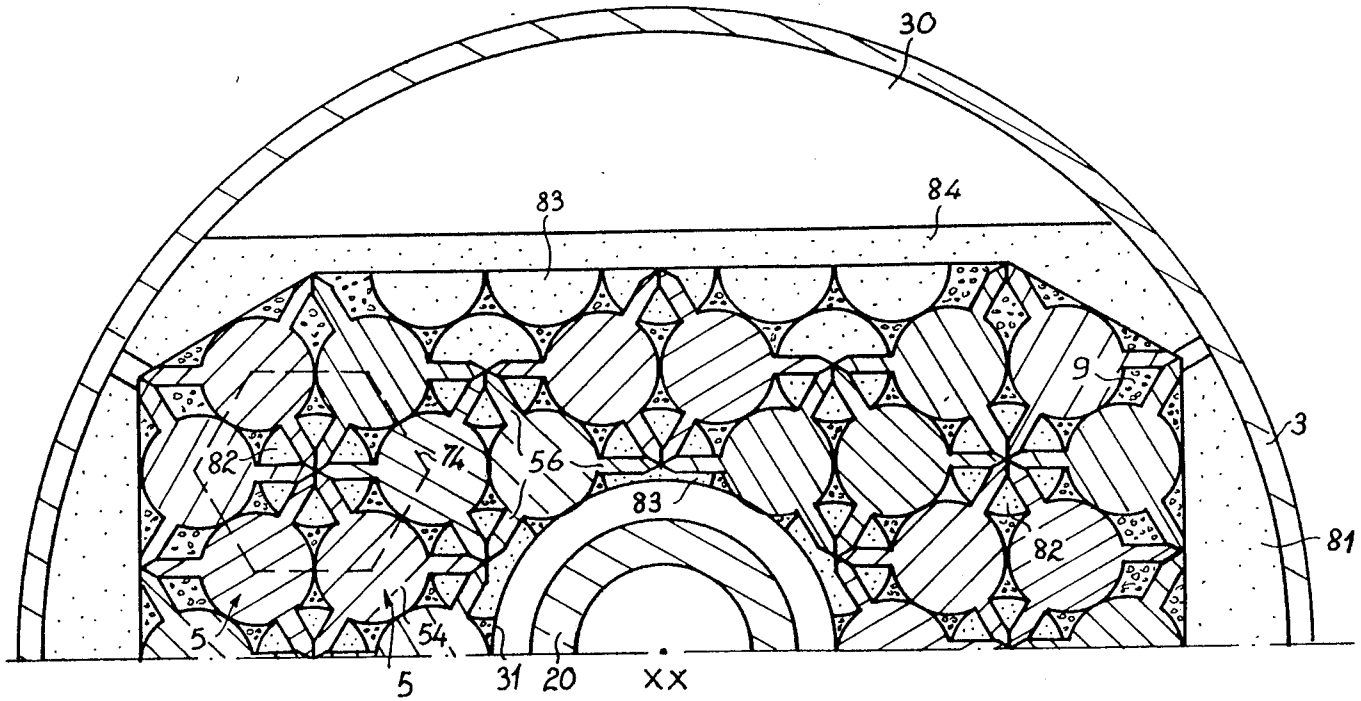
FIG. 4 shows an embodiment of the arrangement of the sub-munitions according to the invention.

One embodiment of a method to arrange the sub-munitions 5 inside the projectile 1 is given in FIG. 4, which gives a cross-section view of half of the projectile 1 of FIG. 1 at the fin system of the sub-munitions of one of the rows 71, 72, or 73.

This cross-section view shows the external casing 3 and, towards the center, a shaft 20 supporting the nose 2 and an inner casing 31. The shaft 20 of the nose can be moved in the casing 31 to enable the ejection of the nose as described further below. All the sub-munitions 5 are arranged between the casings 3 and 31.

In this embodiment, the central part (the interior of the casing 31) of the projectile contains no sub-munitions. However, the transversal dimensions of the casings 31 are small enough for this fact not to result in any inconvenient gaps in the zone Z (FIG. 1).

The FIG. 4 also shows the shell 54 of each of the sub-munitions 5 and their fin systems 56, the elements 54 and 56 being shown with hachured lines to make the drawing clearer. In this embodiment, the fin system of each sub-munition 5 comprises three fins set at 120° to one another. The shells 54 of the sub-munitions are arranged in a hexagon, one example of which is shown with dashes 74, the center of the shells 54 forming the vertices of the hexagon and the shells 54 being tangential with one another. The fins are set inside one another in such a way that the structure formed by all the sub-munitions is self-locking, i.e. at the center of the hexagon 74, there are six fins respectively belonging to the six sub-munitions 5 of the hexagon, locked into one another.

In a preferred embodiment of the invention, internal securing elements 82 are arranged between the sub-munitions 5, around the shells 54. These elements 82 are, for example, shaped substantially like cylinders and extend along the entire length of the shells 54 or along only a part of these shells. For the clarity of FIG. 4, the surface of the elements 82 is depicted by dots. The function of these internal securing elements 82 is to increase the rigidity of all the sub-munitions 5, especially when the projectile is driven by a rotational motion on its longitudinal axis. In a preferred embodiment, the securing elements 82 are made of a flexible material such as plastic foam, pre-stressed so as to compensate for any gaps in the structure. Between the sub-munitions 5 and the inner casing 31, truncated securing elements, marked 83, may be positioned. Their purpose too is to increase the rigidity of the structure.

Between the structure formed by all the sub-munitions 5 and the external casing 3, there are also securing elements marked 81. The function of these securing elements 81 is to prevent the sub-munitions 5 from being moved outwards, off direction. These elements 81 have a shape adapted to the unoccupied space between the structure formed by the sub-munitions and the external casing 3. They do not obligatorily have a constant cross-section. They are made, for example, of a plastic material and are preferably made of a relatively rigid material that can break up when the sub-munitions are ejected, according to a mechanism described below, so that they do not interfere with this ejection process.

The means used to secure the loading of the sub-munitions further comprise securing elements 84, similar to the elements 81, intended to retain the load and leave the space 30 unoccupied.

Finally, the spaces left unoccupied between the casings 31 and 3 by the sub-munitions 5 and the securing elements 81, 82, 83 or 84 are filled with a powdery material 9. The function of this powdery material is, firstly, to provide for better immobilization of the sub-munitions 5 in the casing 3 and, secondly, to ensure that the rows 71, 72 and 73 are separated (see FIG. 3*a*) for a reason related to the ejection of the sub-munitions, as explained below. This powder 9 can also be used to make the sub-munitions releasing point visible thus facilitating the use of the system.

The main projectile 1 (FIG. 3*a*) also has a disk 6 that encloses the space between the casings 3 and 31 behind the loading space of the sub-munitions. This disk 6 is actuated by propulsion means 4 when the sub-munitions are released.

Figure 3B:
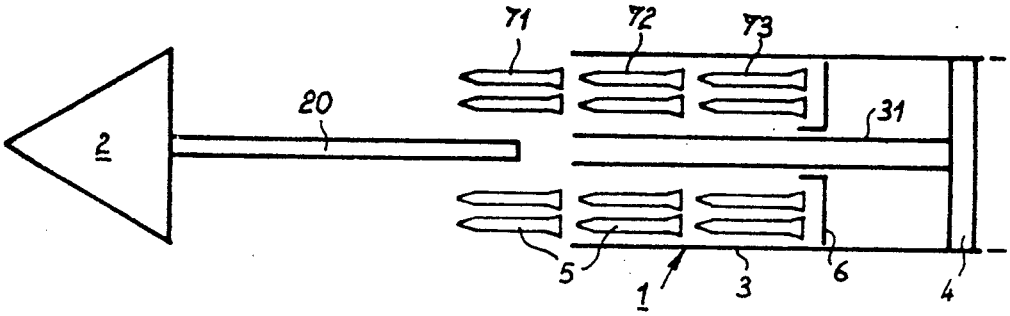
Figure 3C:
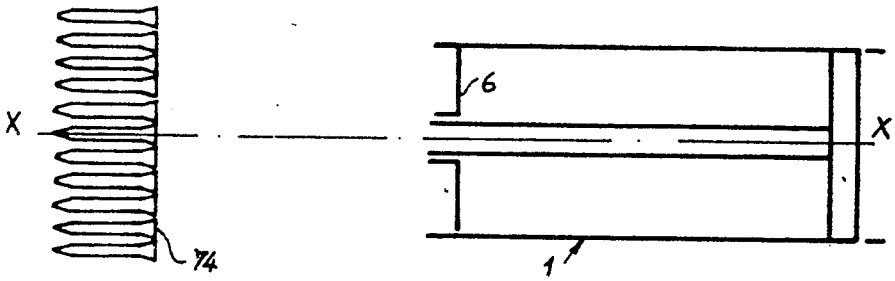

FIGS. 3*b* and 3*c* are diagrams illustrating the mechanism for ejecting the sub-munitions 5 from the main projectile 1.

In a first stage, under the effect of the propulsion means 4 depicted schematically behind the projectile 1, the shaft 20 of the nose 2 slides inside the casing 31 until the said nose is separated from the projectile. This nose is designed so that it then remains stable and does not disturb the movement of the sub-munitions while they are being ejected or that of the main projectile.

In a second stage, the propulsion means 4 give the disk 6 a relatively forward movement with respect to the casing 3, leading to the successive ejection of the rows 71, 72 and 73 of sub-munitions 5. During the ejection of all the rows 71 to 73, the securing elements 81 to 84 and the powdery material 9 are separated from the sub-munitions as and when the said sub-munitions appear at the edge of the casing 3.

FIG. 3*b* shows the moment when the nose 2 is entirely ejected from the casing 3 and when the first of the rows, namely the row 71, is also entirely ejected.

As is known, on leaving the casing 3, each sub-munition 5 has a relative longitudinal velocity as well as a radial velocity, often called the expansion velocity, caused by the aerodynamic force exerted upon it when it leaves the casing 3 and, as the case may be, by the rotation of the main projectile on itself. Furthermore, each row, upon making its exit, is slowed down by this aerodynamic force. These two phenomena in combination give an interpenetration between the various rows as shown in FIG. 3*c* where, since the three rows are all ejected, the various sub-munitions 5 are substantially on the same line 74 where they form a single cone of dispersion driven by a longitudinal velocity and a radial expansion velocity.

The radial expansion velocity can be controlled thus making it possible, by choosing the shape of the sub-munitions loading space, to adapt the shape of the cone of dispersion to that of the desired zone of effectiveness. This expansion velocity depends on the rotational speed of the projectile 1, the dimensioning of the securing elements and the geometrical characteristics of the sub-munitions and their position with respect to the longitudinal axis (XX) of the main projectile.

The experiments and calculations of the Applicant have shown that it is moreover important for the heads of the sub-munitions of one row to have no mechanical contact with the rear of the sub-munitions of the previous row, so as to prevent a rear sub-munition from disturbing and pushing the sub-munition in front of it off direction. Furthermore, the gap between the rows should be sufficient for the rows to be interpenetrated properly, without any contact (or at least with a minimum degree of contact) among sub-munitions. This separating function is fulfilled, as explained above, by the powdery material 9.

Thus the sub-munitions are held rigidly in position before ejection so that, at the moment of ejection, they are capable of following the planned trajectory. Furthermore, means are provided so that, during this ejection, the trajectory of each sub-munition is disturbed neither by the various constituent elements of the main projectile nor by the other sub-munitions.

The above description has been given as a non-exhaustive example. Thus, the main projectile has been described as having a cylindrical shell with a circular cross-section, but this cross-section may take other shapes. For example, it could be square-shaped, in which case the sub-munitions would have four fins. More generally, other geometrical shapes can be used for the shell of the projectile, the shell and fin system of the sub-munitions and their organization (hexagonal in FIG. 4) provided that the shells of the sub-munitions are tangential with one another and that their fin systems are organized in a self-locking way.

Moreover, we have described an application of the air-to-ground or ground-to-ground type. Other applications are, of course, possible such as those where the target zone is at sea or in the air (anti-helicopter projectile carriers for example).

What is claimed is:

1. A projectile containing sub-munitions in a sub-munitions loading space, said projectile comprising:

means for determining a predetermined trajectory for said sub-munitions subsequent to ejection, said trajectory of said ejected profile forming a first angle with the ground on which is located a predetermined zone of effectiveness, and wherein the shape of the cross-section of said sub-munitions loading space is a function of the geometry of said predetermined zone of effectiveness and said angle between the trajectory of the main projectile and said ground and wherein said shape of the cross-section of said sub-munitions loading space is substantially homothetical with said shape of said predetermined zone of effectiveness.

2. A projectile according to claim 1, comprising an external casing, wherein each sub-munition comprises a shell fitted with a head and a fixed fin system, and wherein said means for determining a predetermined trajectory comprise:

the arrangement of the sub-munitions in one and the same direction, with the head pointed towards the front of the projectile, in a least one row, the sub-munitions in each row being tangential with respect to one another, the fin systems being placed within one another so as to be self-locking, said sub-munitions forming a structure, securing means placed between said external casing and said structure formed by the sub-munitions, a powdery substance placed in the spaces between said sub-munitions and said securing means.

and means for the ejection of the sub-munitions through the front of the projectile.

3. A projectile according to claim 1 further comprising a means for providing a radial expansion velocity of said sub-munitions in order to determine the dimensions of said cross-section of said sub-munitions loading space.

* * * * *